United States Patent [19]

Shekleton

[11] Patent Number: 4,967,563

[45] Date of Patent: Nov. 6, 1990

[54] TURBINE ENGINE WITH HIGH EFFICIENCY FUEL ATOMIZATION

[75] Inventor: Jack R. Shekleton, San Diego, Calif.

[73] Assignee: Sundstrand Corporation, Rockford, Ill.

[21] Appl. No.: 283,070

[22] Filed: Dec. 12, 1988

[51] Int. Cl.[5] ..... F23R 3/00

[52] U.S. Cl. ..... 60/743; 60/39.286

[58] Field of Search ..... 60/737, 738, 743, 39.826; 123/531; 239/424, 533.12

[56] References Cited

U.S. PATENT DOCUMENTS

| | | | |
|---|---|---|---|
| 1,052,588 | 2/1913 | Janicki . | |
| 2,706,520 | 4/1955 | Chandler . | |
| 2,929,209 | 3/1960 | Schirmer . | |
| 3,009,320 | 11/1961 | Paiement . | |
| 3,353,351 | 11/1967 | Bill et al. | 60/743 |
| 3,355,884 | 12/1967 | Poucher et al. | 60/743 |
| 3,469,394 | 9/1969 | Beheim . | |
| 3,531,937 | 10/1970 | Sneeden | 60/738 |
| 3,977,186 | 8/1976 | Arvin et al. . | |
| 4,036,582 | 7/1977 | Fehler et al. . | |

*Primary Examiner*—Louis J. Casaregola
*Assistant Examiner*—Timothy S. Thorpe
*Attorney, Agent, or Firm*—Wood,Phillips,Mason,Recktenwald & VanSanten

[57] ABSTRACT

Excellent fuel atomization in a turbine engine may be obtained with fuel injectors 46 including elongated, laminar discharge orifices 72 and impingement surfaces 76 disposed in the path of fuel 78 being discharged through the discharge orifices 72. Preferably, the fuel 78 is discharged as a flat spray generally tangentially to the annular combustion space 40 of an annular combustor 26.

8 Claims, 2 Drawing Sheets

TURBINE ENGINE WITH HIGH EFFICIENCY FUEL ATOMIZATION

FIELD OF THE INVENTION

This invention relates to gas turbine engines, and more particularly, to gas turbine engines provided with inexpensive, high efficiency fuel atomizing fuel injectors to enhance reliability.

BACKGROUND OF THE INVENTION

In relatively small turbine engines in airborne environments, fuel flows at high altitudes, particularly during starting, are frequently quite low. Consequently, fuel injectors requiring high fuel pressures are commonly used to achieve pressure atomization of the fuel. However at low turbine speeds, it is difficult with available fuel pumps to generate the necessary fuel pressure. Further at such low speeds, the compressor of the turbine will not be delivering a large volume of compressed air and the atomization assist resulting from air blast atomization of fuel is unavailable. By way of example, in a typical worst case, the pressure drop across the combustor is about one inch of water which ordinarily is insufficient to provide acceptable fuel atomization.

To meet these difficulties, conventional injectors have extremely small orifices to provide the desired atomization making them precision formed parts. They are thus costly to manufacture. At the same time, because of the very small orifices employed, they are prone to plugging, a factor that clearly detracts from reliability. Where swirl pressure atomizing fuel injectors are used, with viscous fuels, high losses occur which reduce atomization efficiency and atomization is frequently unsatisfactory.

The present invention is directed to overcoming one or more of the above problems.

SUMMARY OF THE INVENTION

It is the principal object of the invention to provide a new and improved turbine engine. More specifically, it is an object of the invention to provide a new and improved fuel injection system for a turbine engine which provides excellent fuel atomization adequate to provide reliable starting at low fuel flows such as occur, for example, at high altitudes and which may be manufactured inexpensively.

An exemplary embodiment of a gas turbine engine made according to the invention includes a rotary compressor along with a turbine wheel coupled thereto to drive the same. An annular nozzle is disposed proximate to the turbine wheel for directing gases of combustion at the turbine wheel and an annular combustor defining a annular combustor space is disposed about the turbine wheel. The combustor is in fluid communication with both the compressor and the nozzle and receives fuel from a source and air from the compressor to combust the fuel with the air to generate the gases of combustion. There is provided a plurality of fuel injectors at circumferentially spaced locations about the combustor and each fuel injector comprises at least one generally radially inwardly opening elongated, laminar discharge orifice and a fuel impingement surface within the combustor in the path of fuel discharged from the orifice and at an angle thereto so that fuel will be sprayed generally tangential to the combustion space.

In a preferred embodiment, each fuel injector includes an elongated, hollow barrel and each elongated, laminar discharge orifice is a reduced diameter opening from the hollow barrel having a length several times its width.

In a preferred embodiment, each impingement surface is defined by a plate secured to the associated barrel at an acute angle with respect to an end thereof. In a highly preferred embodiment, the plate is made up of two sections which are at an obtuse angle with respect to each other. One of the sections is secured to the barrel near the radially inner end thereof such that the other of the sections is radially inward of the discharge orifice.

When such a plate is used, it is preferred for simplicity that the impingement surface be planar.

The invention contemplates that an air manifold or plenum surround the combustor and that there be a plurality of generally tangentially oriented, elongated air ports formed in the outer wall of the combustor. One such air port is provided for each such injector and they are in fluid communication with the compressor. Each of the injectors has its associated impingement surface disposed within the corresponding one of the air ports.

Other objects and advantages will become apparent from the following specification taken in connection with the accompanying drawings.

DESCRIPTION OF THE PREFERRED EMBODIMENT

Figure 1:
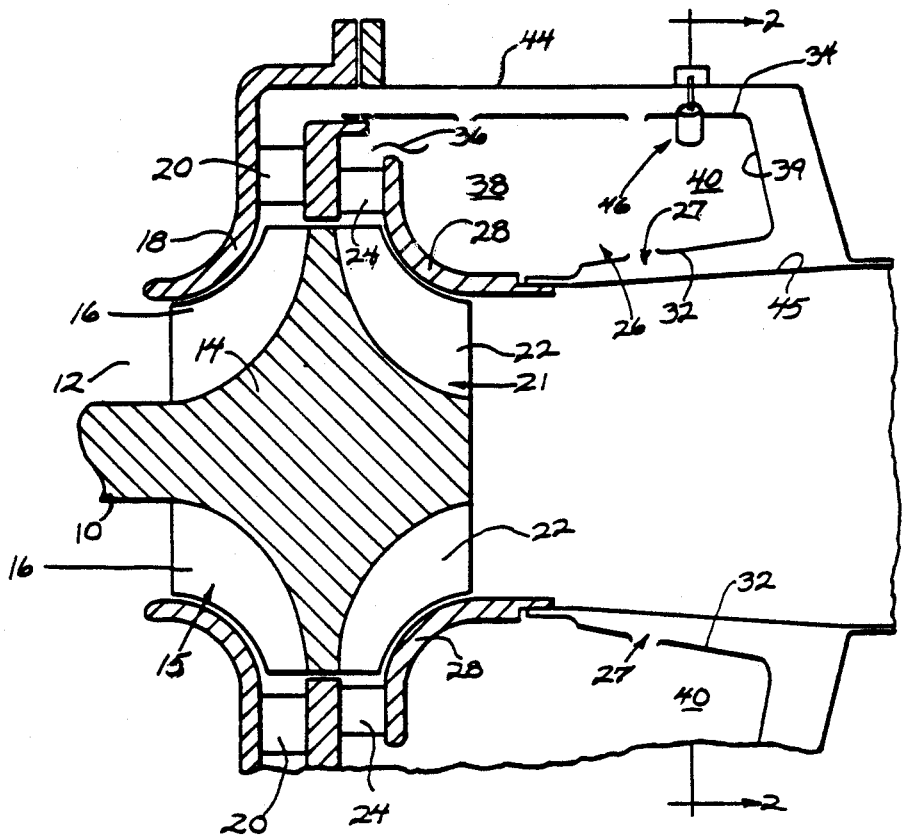
FIG. 1 is a somewhat schematic view of a turbine engine made according to the invention.

An exemplary embodiment of a gas turbine made according to the invention is illustrated in the drawings in the form of a radial flow, air breathing gas turbine. However, the invention is not limited to radial flow turbines and may have applicability to any form of air breathing turbine having an annular combustor.

The turbine includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a compressor section, generally designated 15, including a plurality of compressor blades 16 adjacent the inlet 12. A compressor shroud 18 is provided in adjacency thereto and just radially outwardly of the radially outer extremities of the compressor blades 16 is a conventional diffuser 20.

Oppositely of the compressor blades 16, the rotor 14 includes a turbine wheel, generally designated 21, including a plurality of turbine blades 22. Just radially outwardly of the turbine blades 22 is an annular nozzle 24 which is adapted to receive hot gases of combustion along with a dilution air, from an annular combustor, generally designated 26. The compressor 15 including the blades 16, the shroud 18, and the diffuser 20 delivers compressed air to the annular combustor 26, and via dilution air passages 27, to the nozzle 24 along with the gases of combustion. That is to say, hot gases of combustion from the combustor 26 are directed via the nozzle 24 against the blades 22 to cause rotation of the rotor 14 and thus the shaft 10. The latter may be, of course, coupled to some sort of apparatus requiring the performance of useful work.

A turbine blade shroud 28 is interfitted with the combustor 26 to close off the flow path from the nozzle 24 and confine the expanding gas to the area of the turbine blades 22. The combustor 26 has a generally cylindrical inner wall 32, and a generally cylindrical outer wall 34. The two are concentric with each other and with the rotational axis of the shaft 10 and merge to a necked down area 36 which serves as an outlet from an interior annulus 38 defined by the space between the walls 32 and 34 of the combustor 26. The outlet 36 extends to the nozzle 24. A third wall 39, generally concentric with the walls 32 and 34, extends generally radially to interconnect the walls 32 and 34 and to further define the annulus 38.

Opposite of the outlet 36 and adjacent the wall 39, the interior annulus 38 of the combustor includes a primary combustion zone 40 in which the burning of fuel primarily occurs. The primary combustion zone 40 is an annulus or annular space defined by the generally radially inner wall 32, the generally radial outer wall 34, and the radial wall 39. Other combustion may, in some instances, occur downstream from the primary combustion zone 40 in the direction of the outlet 36. As mentioned earlier, provision is made for the injection of dilution air through the passages 27 into the combustor 26 to cool the gases of combustion to a temperature suitable for application to the turbine blades 22 via the nozzle 24.

A further annular wall 44 is generally concentric to the walls 32 and 34 and is located radially outward of the latter. Similarly, an inner annular wall 45 inside the wall 32 is provided and together with the wall 44 provides a plenum surrounding the combustor 26.

Figure 2:
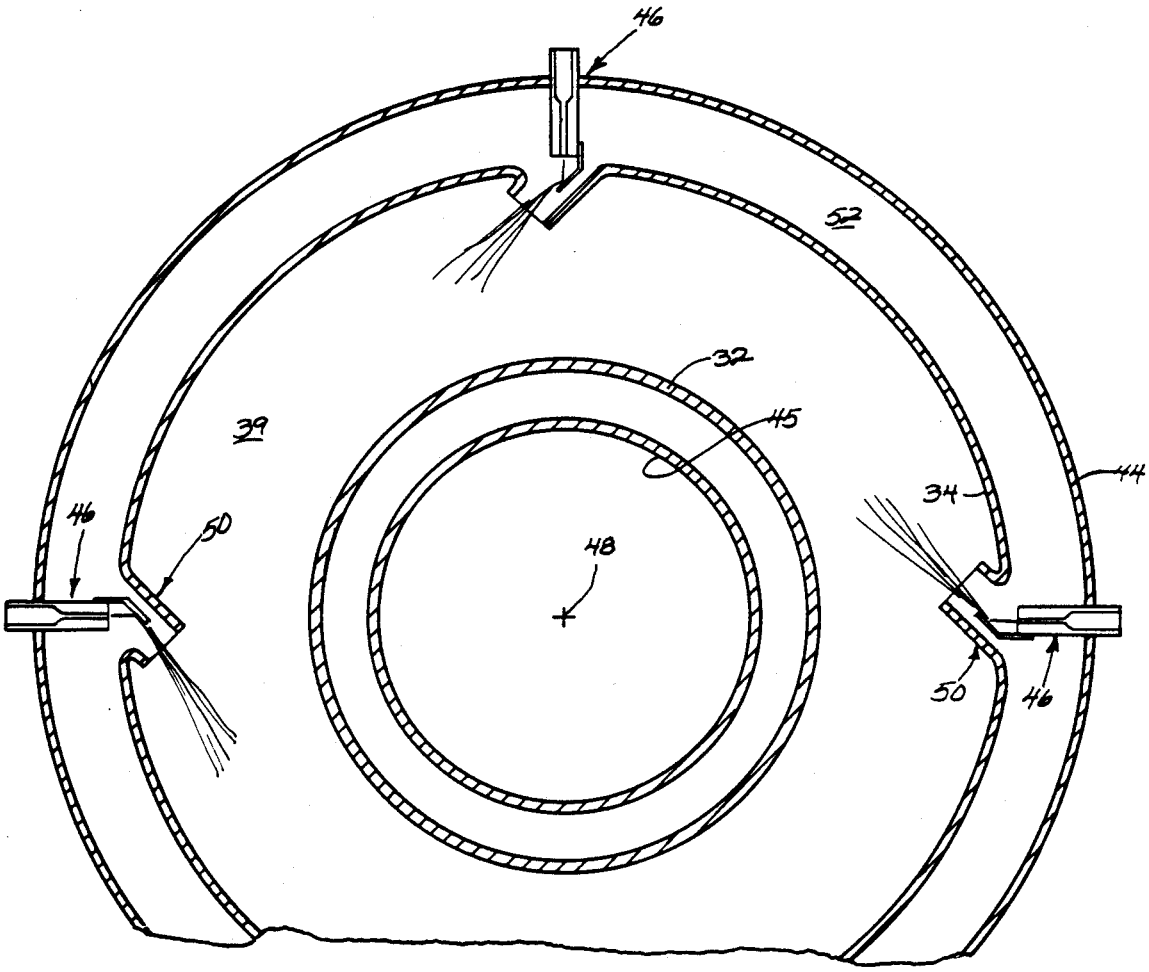
FIG. 2 is a sectional view taken approximately along the line 2—2 of FIG. 1.

Mounted on the wall 44, and extending through the wall 34, are main fuel injectors, generally designated 46. As seen in FIG. 2, according to a preferred embodiment of the invention, there are a plurality of the injectors 46, namely, in the particular instance shown, four, at preferably equally angularly spaced or circumferentially separated locations about the axis of rotation of the shaft 10 which is designated by a point 48. Associated with each injector 46 is an air inlet port, generally designated 50. Each air inlet port 50 is in fluid communication with the space 52 between the walls 34 and 44 which serves as a manifold or plenum for compressed air received from the compressor 15.

The air inlet ports are elongated and generally cylindrical in configuration. The cylindrical axis of each is generally tangential to the combustion space defined by the walls 32 and 34 and generally speaking, the axes of each of the ports 50 will be in a single plane that is transverse to the rotational axis 48.

Figure 3:
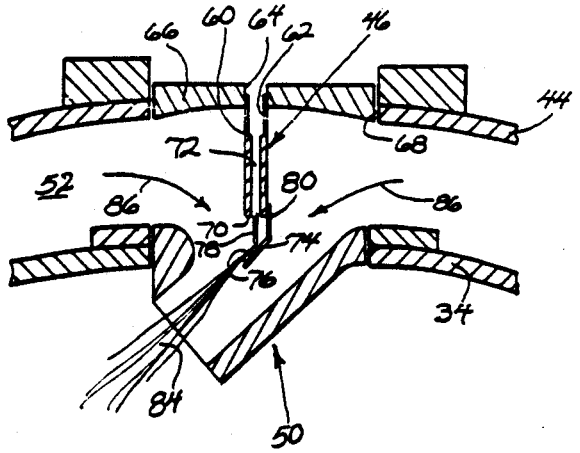
FIG. 3 is an enlarged, fragmentary view of an injector nozzle made according to the invention.

As best seen in FIG. 3, each of the injectors 46 includes an elongated barrel 60 which is hollow as shown at 62. The barrel 60 may be received in an opening 64 in a removable mounting plate 66 suitably secured within an opening 68 in the wall 44.

The barrel 60 is of sufficient length so as to extend radially inwardly and across the manifold 52 to terminate in a discharge end 70 aligned with a corresponding one of the air inlet ports 50. The end 70 is generally transverse to a radius taken from the axis 48 but need not be.

Each barrel 60 terminates in an elongated, laminar discharge orifice 72. That is to say, the orifice 72 is such that for operating conditions contemplated, flow of fuel therethrough will be in the laminar regimen. Frequently this can be accomplished by making the orifice 72 a reduced diameter bore or passage. That is, the diameter of the orifice 72 is reduced from the diameter 62 of the main hollow part of the barrel 60. In addition, the orifice 72 should preferably have a length that is considerably longer than its width, usually a ratio of at least five to one.

Located radially inwardly of the discharge orifice 72 is an impingement plate 74. The impingement plate 74 has a planar impingement surface 76 that faces the orifice 72 and which is at an acute angle with respect to the end 70 and which intersects the column of fuel 78 being discharged through the orifice 72. The plate 74 has two sections, one of which defines the aforementioned planar impingement surface 76. The other section is designated 80 and is at an obtuse angle to the section defined by the impingement surface 76. The section 80 is secured to the end 70 by any suitable means, for example, as by brazing.

The angular relation between the two sections of the plate 74 is such that the column of fuel 78, upon impinging on the surface 76 will be deflected and atomized and sprayed through the associated air inlet port 50 generally along the elongated axis of the same as can be seen in FIG. 3. That is to say, an atomized flat spray 84 of fuel will enter the combustion space defined by the walls 32 and 34 generally tangentially with respect thereto. Atomization of the spray will be enhanced by compressed air from the compressor 15 leaving the manifold 52 and entering the combustor as shown by arrows 86 in surrounding relation to the spray 84.

One very beneficial effect of the use of the laminar discharge orifice is that undesirable difficulties associated with so-called "manifold head" at high altitudes are virtually eliminated. As is well known, at high altitudes where low fuel flow rates are present, fuel pressure required is relatively low with the consequence that the pressure differential due to the head of fuel in a manifold from top to bottom of the engine becomes significant. This in turn means that lower injectors receive fuel at high pressure than higher injectors. As an ultimate consequence, fuel injection is not uniform. The laminar orifices have a relatively high friction loss. As a consequence, the fuel pressure drop across such orifices is increased once again to the point where the pressure differential from top to bottom of the manifold again becomes negligible.

Furthermore, because of the high pressure drop across the laminar orifices 72, the cross sectional area of their respective passages may be increased over conventional orifices without increasing fuel flow. The use of larger passages then provides a fuel flow path that is less prone to clogging.

Another substantial advantage of the invention is that proper atomization of the fuel is achieved by means of the relatively simple and inexpensive instrumentality in the form of the plate 74 and its impingement surface 76. This is in contrast to prior art pressure atomizing injectors wherein the fuel discharge orifices are responsible for atomization and therefore must be precisely formed at considerable expense.

I claim:

1. A gas turbine engine comprising:

a rotary compressor;

a turbine wheel coupled to said compressor to drive the same;

an annular nozzle proximate said turbine wheel for directing gases of combustion at said turbine wheel;

an annular combustor having inner and outer walls defining an annular combustion space disposed about said turbine wheel and having an outlet in fluid communication with air nozzle, said combustor receiving fuel from a source and air from said compressor and combusting the same to generate said gases of combustion;

an annular manifold about said combustor and connected to said compressor;

a plurality of air inlet ports in said outer wall at circumferentially spaced location, said ports being elongated about respective axes, said axes being generally tangential to said space; and a plurality of fuel injectors, one at each of said circumferentially spaced locations about said combustor, each said fuel injector having means for defining at least one radially inwardly opening elongated passage of such size and length that flow of fuel through the passage will be laminar, said elongated passage being aligned with a corresponding air inlet port and a fuel impingement plate within said corresponding air inlet port and in the path of fuel discharged from said elongated passage and at an angle thereto so that fuel will be sprayed in a flat spray generally along the corresponding one of said axes.

2. The gas turbine engine of claim 1 wherein each said fuel injector includes a generally radially inwardly directed barrel and each said plate has two sections, one being at an obtuse angle with respect to the other, one of said sections being secured to said barrel near the radially inner end thereof such that the other of said sections is radially inward of said elongated passage.

3. The gas turbine engine of claim 2 wherein said barrel is hollow and said elongated passage has a reduced diameter opening from said hollow barrel and has a length several times its width.

4. A gas turbine engine comprising:

a rotary compressor;

a turbine wheel coupled to said compressor to drive the same;

an annular nozzle proximate said turbine wheel for directing gases of combustion at said turbine wheel;

an annular combustor defining an annular combustion space disposed about said turbine wheel and in fluid communication with both said compressor and said nozzle, said combustor receiving fuel from a source and air from said compressor and combusting the same to generate said gases of combustion; and a plurality of fuel injectors at circumferentially spaced locations about said combustor, each said fuel injector having means for defining an elongated passage of such size and length that flow of fuel through the passage will be laminar, said elongated passages being radially inwardly opening, each said fuel injector further including a fuel impingement surface within said combustor in the path of fuel discharged from said elongated passages and at an angle thereto so the fuel will be sprayed generally tangential to said combustion space.

5. The gas turbine engine of claim 4 wherein each said fuel injector includes an elongated, hollow barrel and each said elongated passage has a reduced diameter opening from said hollow barrel having a length several times its width.

6. The gas turbine engine of claim 4 wherein each said impingement surface is defined by a plate secured to the associated barrel at an acute angle with respect to an end thereof.

7. The gas turbine engine of claim 4 wherein said impingement surface is planar.

8. The gas turbine engine of claim 4 further including a plurality of generally tangentially oriented, radially outer, air ports in said combustor, one for each said injector and in fluid communication with said compressor, each said injector having its associated impingement surface disposed within the corresponding air port.

* * * * *